United States Patent [19]

Van Den Berg et al.

[11] Patent Number: 4,496,641

[45] Date of Patent: Jan. 29, 1985

[54] METHOD OF MANUFACTURING A COLOUR TELEVISION DISPLAY TUBE AND TUBE MANUFACTURED ACCORDING TO THIS METHOD

[75] Inventors: Jacob Van Den Berg; Johannes G. Van Lent; Francis B. Strik, all of Eindhoven, Netherlands

[73] Assignee: U.S. Philips Corporation, New York, N.Y.

[21] Appl. No.: 459,016

[22] Filed: Jan. 18, 1983

Related U.S. Application Data

[63] Continuation of Ser. No. 174,418, Aug. 1, 1980, abandoned, which is a continuation of Ser. No. 949,603, Oct. 10, 1978, abandoned, which is a continuation of Ser. No. 736,176, Oct. 27, 1976, abandoned.

[30] Foreign Application Priority Data

Oct. 27, 1975 [NL] Netherlands ..... 7512513

[51] Int. Cl.[3] ..... G03G 13/048

[52] U.S. Cl. ..... 430/23; 430/24; 430/53; 430/55; 430/942; 430/25

[58] Field of Search ..... 430/42–47, 430/53, 23, 24, 942, 55; 355/3 CH

[56] References Cited

U.S. PATENT DOCUMENTS

| | | | |
|---|---|---|---|
| 2,682,478 | 6/1954 | Howse | 430/23 |
| 3,001,849 | 9/1961 | Walkup | 430/942 X |
| 3,067,349 | 12/1962 | Kasperowicz et al. | 430/942 X |
| 3,453,639 | 7/1969 | Berman | 430/53 X |
| 3,475,169 | 10/1969 | Lange | 430/42 |
| 3,527,652 | 9/1970 | Ozaki et al. | 427/43.1 |
| 3,708,336 | 1/1973 | Nishizawa et al. | 430/23 |
| 3,986,073 | 10/1976 | Duinker et al. | 313/477 R |

*Primary Examiner*—John D. Welsh
*Attorney, Agent, or Firm*—Robert J. Kraus

[57] ABSTRACT

A method of making a colour display screen for a television display tube is disclosed. On the window portion of the tube an electron-absorbing layer is provided which is scanned by means of an electron beam via the shadow mask. The charge image on the layer is then developed xerographically. The layer is preferably photoconductive so as to be able to remove the charge remaining after the development by means of a uniform exposure.

10 Claims, 1 Drawing Figure

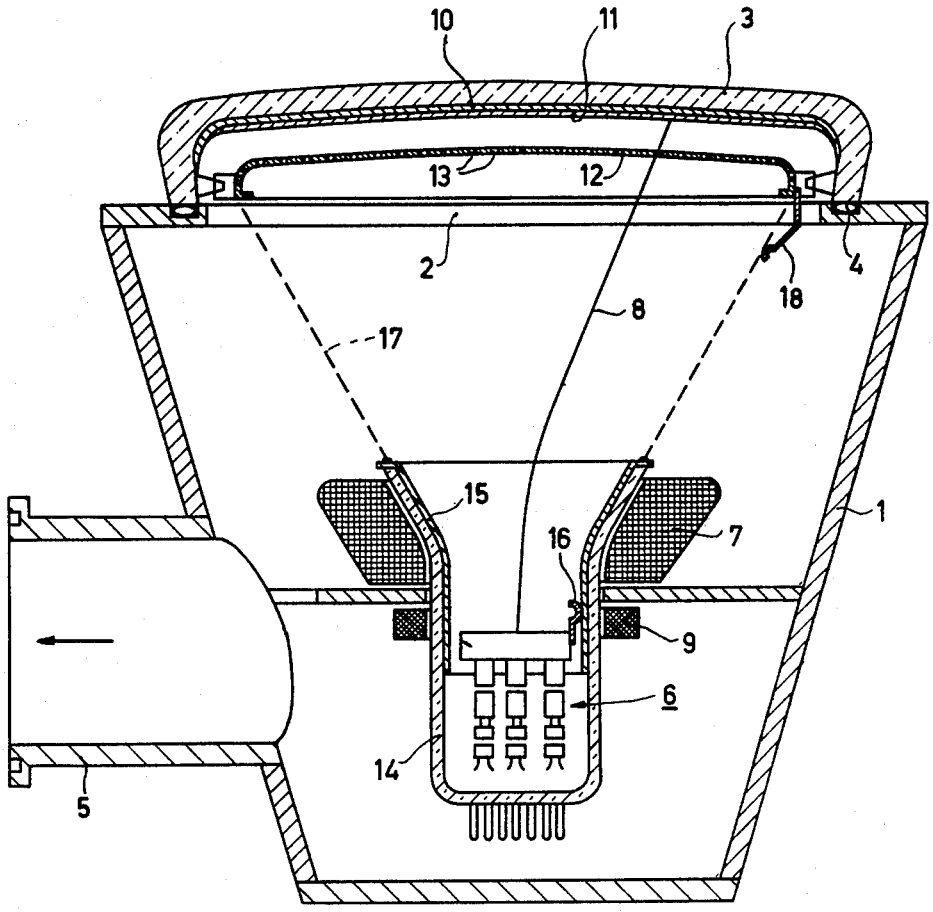
10
11
3
13
12
2
4
18
8
17
15
1
16
7
9
6
14
5

METHOD OF MANUFACTURING A COLOUR TELEVISION DISPLAY TUBE AND TUBE MANUFACTURED ACCORDING TO THIS METHOD

This is a continuation of application Ser. No. 174,418, filed Aug. 1, 1980, which was a continuation of Ser. No. 949,603, filed Oct. 10, 1978, both now abandoned and which was a continuation of Ser. No. 736,176, filed Oct. 27, 1976, now abandoned.

BACKGROUND OF THE INVENTION

The invention relates to a method of manufacturing a colour television display tube having an apertured colour selection elctrode positioned a short distance in front of the display screen. The invention also relates to a colour television display tube manufactured according to such a method.

Such a method is disclosed in U.S. Pat. No. 3,475,169. In this method, first a conductive layer and then a photoconductive layer is provided on a window portion of the tube. The photoconductive layer is then uniformly electrically charged and subsequently exposed through the apertured colour selection electrode. In the exposed portions of the photoconductive layer the charge leaks away as a result of photoconductivity, whereas the charge is maintained in the unexposed portions. The electrostatic potential image obtained in this manner is developed by means of a suspension of phosphor particles or particles of a light-absorbing pigment in a nonpolar liquid. The particles in the suspension obtain a positive or negative charge by the addition of a surface-active stabilizer. The great advantage of this method is that both a positive and a negative reproduction of the potential image and hence of the pattern of apertures in the colour selection electrode can be obtained. The charged particles in the suspension used in the development of the latent image actually adhere on the regions whereafter the exposure charge remains if their charge is opposite to the charge of the photoconductive layer. If their charge is the same as the charge of the photoconductive layer, they just adhere between the charged regions of the potential image.

U.S. Pat. No. 2,848,295 discloses another method. In this method a photoconductive layer containing phosphor particles is provided on the window portion of the tube. In the unexposed state the layer is water-soluble and it becomes insoluble when exposed through the apertured colour selection electrode. The exposed portions of the light-sensitive layer become hardened and insoluble, whereas the unexposed portions remain soluble. The layer is then developed by rinsing with water as a result of which a phosphor pattern is obtained in the exposed portions of the photosensitive layer. According to U.S. Pat. No. 2,848,295, the exposure is not performed with light but with an electron beam which is scanned across the colour television electrode and the window portion of the tube. The great advantage that this method has over the light exposure methods is that it obviates the need for correction lenses required in the latter to bring the virtual position of the light source in agreement with the position of the deflection point of the electron beams in the operating tube. Although the light exposure method has up to now been very common, it does not duplicate the paths of the electron beams in the final tube with sufficient accuracy. The path of the electron beam in an electron beam exposure method on the other hand, can in theory be identical and in practice substantially identical, to the path of the electron beams in the operating tube.

SUMMARY OF THE INVENTION

It is the object of the invention to provide a method of manufacturing a colour television display tube with which the advantages of an exposure with a scanning electron beam go hand in hand with the advantages of a development of an electrostatic potential image with a suspension of electrically charged particles.

For that purpose, a method according to the invention comprises the following steps:

(a) providing a conductive layer on a window portion of the tube, (b) providing an electron-absorbing layer on the conductive layer, (c) scanning the window portion—with the colour selection electrode in the said position—with an electron beam to form a charge pattern on the electron-absorbing layer behind the apertures in the colour selection electrode, (d) developing the charge pattern with electrically charged particles.

Such a method is thus not a combination of the known methods described above. As a matter of fact, such a combination in which a uniformly charged photoconductive layer would be exposed with an electron beam is unnecessarily complicated and would be possible only if the photoconductive layer is charged positively. The method according to the invention uses the charge which the scanning electron beam transports for charging the layer on the window portion with, the charge being deposited directly in the form of a potential image.

The electron-absorbing layer preferably is also photoconductive and after the development (step d) it is exposed to remove the remaining charge of the charge pattern. The exposure is preferably a short uniform exposure to ultraviolet light in which the colour selection electrode is no longer present. The remaining charge, might as a matter of fact, seriously disturb a next charge pattern to be provided. However, the exposure enables the steps c and d to be repeated to provide a subsequent pattern of electrically charge particles. In this manner, patterns of red, green and blue luminescing phosphor particles, respectively, can be provided successively.

A method according to the invention may also be used to provide a light-absorbing layer having apertures for the luminescent regions. In this case, step c is carried out simultaneously or successively, for example three times, with three electron beams to provide three interlacing charge patterns. The lacing charge patterns are then developed with a light-absorbing pigment which covers the areas between the charge regions. The term interlacing charge patterns as used herein is to be understood to mean charge patterns in which the charge regions of each of the patterns are disposed between charge regions of the other patterns.

By means of a method according to the invention it is also possible to obtain a reduced or narrowed reproduction of the apertures in the colour selection electrode in the form of charge regions on the electron-absorbing layer. In this manner a display tube is obtained having negative tolerance in which the electron spots overlap the phosphor regions. For that purpose, the potential of the colour selection electrode during the exposure to the electron beam is chosen to be lower than the potential of the conductive layer on the window portion. However, the potential difference not only focuses the electron beam but also provides a small deflection of the beam in the direction of the center of the window portion. This effect can be compensated for by means of an axial displacement of the deflection coil which is used for the scanning and a magnetic ancillary field between the electron gun and the deflection coil.

By varying the potential difference between the conductive layer and the colour selective electrode during the exposure in a manner which is correlated with the instantaneous position of the electron beam during scanning of the window portion, the dimensions of the charge regions can be varied over the window portion. In this case a display tube can be obtained in which the landing tolerance of the electron beams on the phosphor regions varies over the display screens and is, for example, larger in the corners the. By means of an additional magnetic field a small movement can moreover be superimposed on the scanning movement of the electron beam to increase or widen the charge regions on the electron-absorbing layer. By combining the increase or widening with the reduction or narrowing by means of a potential difference between the conductive layer and the colour selection electrode, any desired distribution of the landing tolerance on the electron beam over the display screen can be obtained.

BRIEF DESCRIPTION OF THE DRAWING

The invention will now be described in greater detail with reference to the accompanying drawing the sole FIGURE of which shows a device for carrying out a method according to the invention.

DESCRIPTION OF THE PREFERRED EMBODIMENTS

The device shown comprises a metal housing 1 which has an aperture 2 in its upper side. Di on the housing above the aperture 2 is a window portion 3 of a colour television display tube to be manufactured. A rubber sealing ring 4 ensures a vacuum-tight seal between the window portion 3 and the housing 1. The housing 1 further comprises a port 5 which can be connected to a vacuum pump so as to evacuate the device. Mounted in the housing 1 are an electron gun 6, a set of deflection coils 7 which deflect an electron beam 8 generated by the electron gun 6 over the window portion 3, and an extra set of deflection coils 9. In order to be able to reach a sufficiently low pressure in the device in a sufficiently rapid manner, the sets of deflection coils 7 and 9 are impregnated with a synthetic resin. The electron gun 6 is of a known construction which generates three beams of the type also used in colour television display tubes. However, the electron beams can be switched on and off separately so as separately expose each phosphor pattern to be provided. The position of the electron gun and deflection coils 1 with respect to the window portion 3 is the same as their respective positions relative to the window portion 3 in the finished tube. The electron gun 6 is mounted in a glass neck 14 which has an internal conductive coating 15. The last electrode of the electron gun 6 is connected to the conductive coating 15 by means of a contact spring 16. Between the conductive coating 15 and the colour selection electrode 12 is disposed a metal cone 17 of gauze wire which is connected to the colour selection electrode 12 by means of a contact spring 18. The space between the last electrode of the electron gun 6 and the colour selection electrode 12 thus is an equipotential space.

A method according to the invention is carried out as follows by means of the device shown.

First a transport conductive layer 10 and an electron-absorbing layer 11 are provided on a window portion 3. The thickness of the layer 11 should be approximately equal to or larger than the average depth of penetration of the electrons of the electron beam 8. Furthermore, the secondary emission factor should be smaller than 1. With these conditions, a negative charge pattern can be provided on the layer 11 by means of electron beam 8. The layer 10 has a thickness of 2 to $6\times10^{-2}$ $\mu$m and consists of vapour-deposited metal, for example magnesium or chromium nickel. The layer 11 has a thickness of 2 to 10 $\mu$m and consists of poly-N-vinylcarbazol. The layer 11 is not only electron-absorbing but, in addition, is also photoconductive so that any charge pattern remaining after the development can be removed by means of a short uniform exposure to ultraviolet light.

The colour selection electrode 12 with the apertures 13 is then mounted in the window portion 3 and the window portion 3 is placed on the housing 1. The device is then evacuated to a pressure of $10^{-5}$ mmHg.

An electron beam 8 having an energy of 6 to 20 KeV is then generated by means of the electron gun 6. The energy of the electron beam should be sufficiently large to render negligible the influence of disturbing fields, for example, the earth's magnetic field. The colour selection electrode 12 is scanned by the electron beam by means of the set of deflection coils 7 and negatively charged regions are then formed behind the aperture 13 on the electron-absorbing layer. The charge regions are substantially of the same size as the apertures 13 if the conductive layer 10 and the shadow mask 12 have the same potentials. Of course, the current through the deflection coils 7 should be adapted to the energy of the electron beam. The form of the magnetic field which is generated by the deflection coils should be equal to the form of the magnetic field of the deflection coils of the operating tube. The deflection coils 7 are therefore identical to the deflection coils of the operating tube. By choosing the potential of the colour selection electrode 12 to be a few kilovolts lower than the potential of the conductive layer 10, charge regions can be obtained which are smaller or narrower than the apertures 13. By varying the potential difference between the colour selection electrode 12 and the conductive layer 10 during the scanning, the reduction or narrowing of the charge regions can be varied over the window portion 3. The scanning by means of the electron beam 8 may, for example, be in the form of a pattern of parallel lines in which the whole window portion is scanned 25 times per second. With a beam current of 0.05 mA it was found possible to provide a charge pattern of a sufficient strength in 15 seconds.

The pressure in the housing 1 is then increased again to atmospheric pressure and the window portion 3 is removed. After removing the colour selection electrode 12 from the window portion 3, a phosphor suspension with positively charge phosphor particles is sprayed against the window portion 3, the positive phosphor particles adhering only to the negative charge regions on the layer 11. This step is termed the development of the charge image. Any remainder of the charge image which is not entirely neutralised by the phosphor particles is removed by subsequently exposing the layer 12 to ultraviolet light so that the layer 12 becomes photoconductive.

The method described is then repeated for a second colour of phosphor and then for a third colour of phosphor, in which the second and the third beam which the electron gun 6 can generate are used. Suspensions containing charged phosphor particles are known per se from the previously mentioned U.S. Pat. No. 3,475,169.

By means of the method according to the invention it is also possible to provide a light-absorbing layer on the window portion 3. As is known, such a light-absorbing layer increases the contrast of the displayed picture. For that purpose, the layer 11 is exposed successively or simultaneously with the three electron beams which the electron gun 6 can generate without intorim development and is then developed with a suspension of negatively charged particles of a light-absorbing pigment. The light-absorbing pigment then adheres only between the likewise negative charge regions on the layer 11.

By means of the extra set of deflection coils 9, a small extra movement can be superimposed upon the scanning movement of the electron beams which is obtained by means of the set of deflection coils 7. In this manner the charge regions can be increased or widened relative to the apertures 13. Together with the previously stated reduction or narrowing of the charge regions which can be obtained by means of a potential difference between the conductive layer 10 and the colour selection electrode 12, the desired landing tolerance of the electron beams can then be obtained at any location on the display screen.

What is claimed is:

1. A method of providing a predetermined pattern of a material on a color television display tube window, including the steps of:

(a) depositing a conductive layer on an inner surface of the window;

(b) depositing on the conductive layer an electron absorbing layer having a thickness at least equal to the average depth of penetration of incident electrons having a predetermined energy;

(c) mounting an apertured color selection electrode at a predetermined distance from the electron absorbing layer;

(d) producing a beam of electrons having said energy and emanating from an electron gun mounted at a predetermined position relative to the color selection electrode;

(e) exposing the electron absorbing layer by scanning the electron beam across the color selection electrode and passing it through the apertures in said electrode to directly form a negative charge pattern on said electron absorbing layer;

(f) removing the color selection electrode from its proximity to the color selection electrode; and (g) developing the charge pattern by applying charged particles of said material to the electron absorbing layer.

2. A method as in claim 1 where the electron absorbing layer is photoconductive, and further including the step of exposing said electron absorbing layer with light radiation to remove charge remaining after development.

3. A method as in claim 2 and further including at least one repetition of steps c through g with the electron gun mounted at a different predetermined position relative to the color selection electrode.

4. A method as in claim 3 where three successively-formed charge patterns are developed by successively applying red, green and blue charged phosphor particles, respectively, to the electron absorbing layer.

5. A method as in claim 1 where steps d and e are performed by producing a plurality of electron beams, each emanating from a different predetermined position relative to the color selection electrode, effecting production of a plurality of interlaced charge patterns on the electron absorbing layer, and where said charge patterns are developed by applying charged particles of light absorbing pigment to said electron absorbing layer.

6. A method as in claim 1 where different potentials are applied to the conductive layer and the color selection electrode while exposing the electron absorbing layer, the potential of the color selection electrode being made smaller than the potential of the conductive layer to effect the formation of charge regions on the electron absorbing layer which are narrower than respective apertures in the color selection electrode.

7. A method as in claim 6 where the difference between the potentials applied to the conductive layer and the color selection electrode is varied in correlation with the instantaneous position of the scanning electron beam, effecting a corresponding variation of the dimensions of the charge regions formed.

8. A method as in claim 1 where a varying magnetic field is applied to the scanning electron beam, increasing the movement of the electron beam and thereby tending to widen the charge regions formed on the electron absorbing layer during exposure.

9. A method as in claim 6 where a varying magnetic field is applied to the scanning electron beam, increasing the movement of the electron beam and thereby tending to widen the charge regions formed on the electron absorbing layer during exposure.

10. A method as in claim 7 where a varying magnetic field is applied to the scanning electron beam, increasing the movement of the electron beam and thereby tending to widen the charge regions formed on the electron absorbing layer during exposure.

* * * * *